US006095603A

United States Patent [19]

Hock

[11] Patent Number: 6,095,603

[45] Date of Patent: Aug. 1, 2000

[54] GANG CHAIR DEVICE

[76] Inventor: Koh Tuang Hock, No.56, Min Sheng Street, Feng-Yuan City 420, Taiwan

[21] Appl. No.: 09/178,240

[22] Filed: Oct. 22, 1998

[51] Int. Cl.[7] ..... A47C 15/00

[52] U.S. Cl. ..... 297/232; 297/248; 297/440.14; 297/440.15; 297/440.16; 297/440.2; 297/440.21; 297/452.11; 297/452.18

[58] Field of Search ..... 297/130, 232, 297/248, 440.14, 440.15, 440.16, 440.2, 440.21, 452.11, 452.2, 452.18

[56] References Cited

U.S. PATENT DOCUMENTS

| | | | |
|---|---|---|---|
| 3,114,575 | 12/1963 | Eames et al. | 297/452.11 X |
| 3,762,765 | 10/1973 | Piretti | 297/232 X |
| 3,885,766 | 5/1975 | Resch et al. | 297/232 X |
| 3,979,149 | 9/1976 | Vogel | 297/232 |
| 4,277,101 | 7/1981 | Vogel | 297/232 |
| 4,557,521 | 12/1985 | Lange | 297/452.11 X |
| 4,730,873 | 3/1988 | Janz | 297/232 X |
| 4,776,635 | 10/1988 | Halliez | 297/452.11 X |
| 4,989,915 | 2/1991 | Hansal | 297/232 X |
| 5,292,177 | 3/1994 | Balderi et al. | 297/248 X |
| 5,328,231 | 7/1994 | Raymond | 297/232 X |
| 5,470,128 | 11/1995 | Kerkham | 297/248 X |
| 5,806,931 | 9/1998 | Kogai | 297/452.2 X |

*Primary Examiner*—Peter M. Cuomo
*Assistant Examiner*—Rodney B. White

[57] ABSTRACT

A gang chair device has a crossbar, two leg devices connected to the crossbar, and a plurality of chairs disposed on the crossbar. Each leg device has a leg plate having a protruded plate and an extended rod. A connection plate is disposed on the extended rod. The crossbar has two block plates and a slot defined by the block plates. A U-shaped plate is inserted in the crossbar. Each chair has a backrest plate having two insertion plates, two hollow blocks, a seat plate, a base plate, and a U-shaped positioning plate. The base plate is disposed on the crossbar. The seat plate is disposed on the base plate. The base plate has two J-shaped lateral rods. Each J-shaped lateral rod has an opening. Each insertion plate is inserted in the hollow block. Each hollow block has a tip end inserted in the opening.

3 Claims, 8 Drawing Sheets

GANG CHAIR DEVICE

BACKGROUND OF THE INVENTION

This invention relates to a gang chair device, and more particularly to a gang chair device which is assembled stably.

A conventional gang chair device has a plurality of seat plates which are easily detached from the conventional gang chair device, and a plurality of backrest plates which are easily deformed. It is difficult to assemble the conventional gang chair device. It is difficult to repair the conventional gang chair device also.

SUMMARY OF THE INVENTION

An object of this invention is to provide a gang chair device which is assembled stably.

Another object of this invention is to provide a gang chair device which can be positioned stably.

Accordingly, a gang chair device comprises a hollow crossbar, two leg devices connected to the hollow crossbar, and a plurality of chairs disposed on the hollow crossbar. Each of the leg devices has a leg plate having a protruded plate and an extended rod disposed on the protruded plate. The protruded plate has a threaded aperture. A screw rod fastens the extended rod and the protruded plate via the threaded aperture. The extended rod has a threaded center hole. A connection plate is disposed on the extended rod. The connection plate has a notch, a central hole, a first round hole, a second round hole, and a plurality of lug bars. The hollow crossbar has two block plates and a slot defined by the block plates. A U-shaped plate is inserted in the hollow crossbar. The U-shaped plate has two positioning holes. Each of the chairs has a backrest plate having two insertion plates, two hollow blocks, a seat plate, a base plate, two armrest frames, and a U-shaped positioning plate receiving the hollow crossbar. The U-shaped positioning plate has two end bars. Each of the end bars has two threaded holes. The seat plate has a plurality of round protrusions. The base plate is disposed on the hollow crossbar. The seat plate is disposed on the base plate. The base plate has two J-shaped lateral rods, a plurality of circular apertures, and a plurality of round recesses receiving the round protrusions. Each of the J-shaped lateral rods has an opening. Each of the insertion plates is inserted in the respective hollow block. Each of the hollow blocks has a hollow interior receiving the respective insertion plate, two through holes, and a tip end inserted in the respective opening. Each of the armrest frames has a lower base positioned on the base plate.

DETAILED DESCRIPTION OF THE INVENTION

Figure 1:
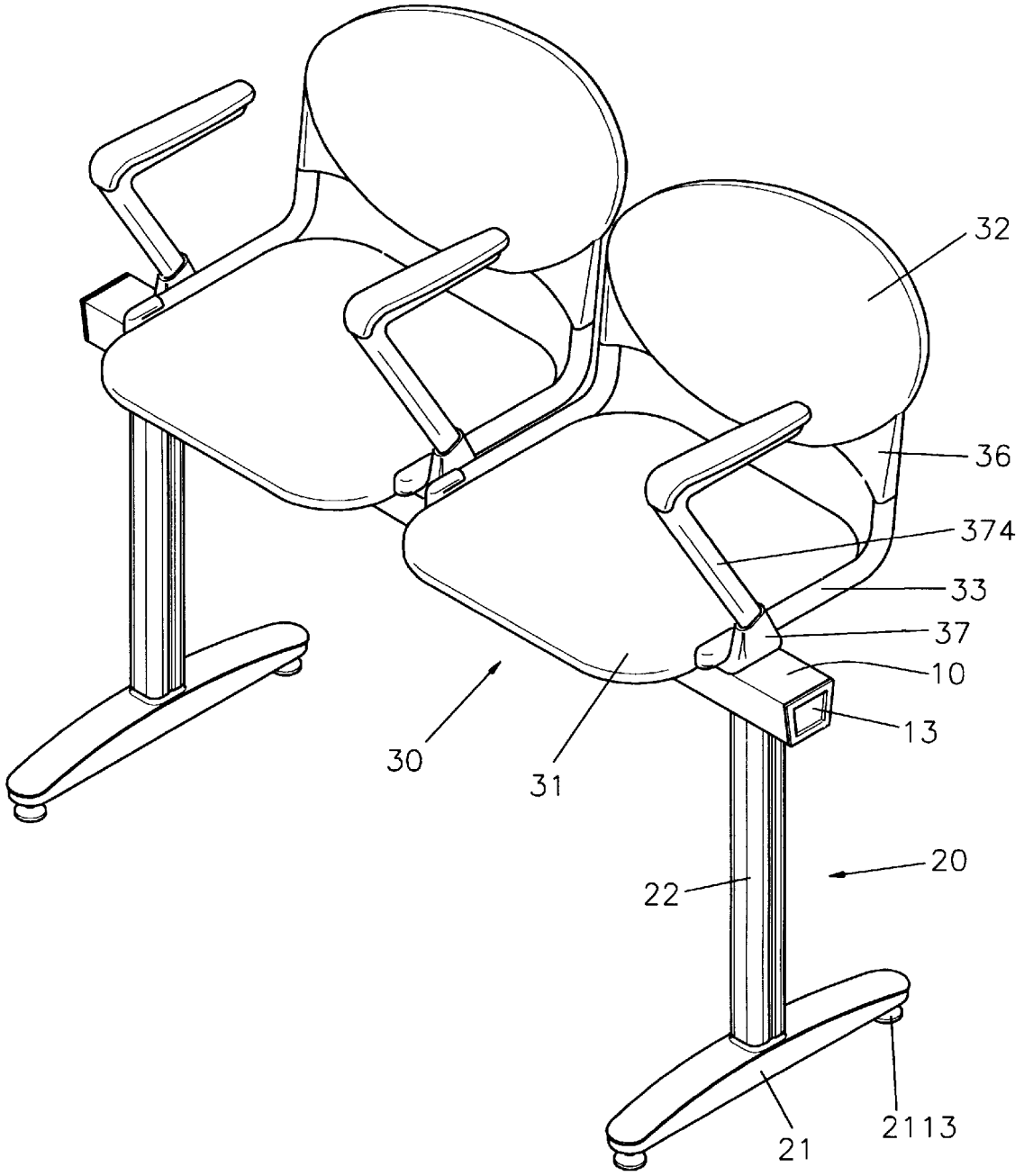
FIG. 1 is a perspective assembly view of a gang chair device of a preferred embodiment.
Figure 2:
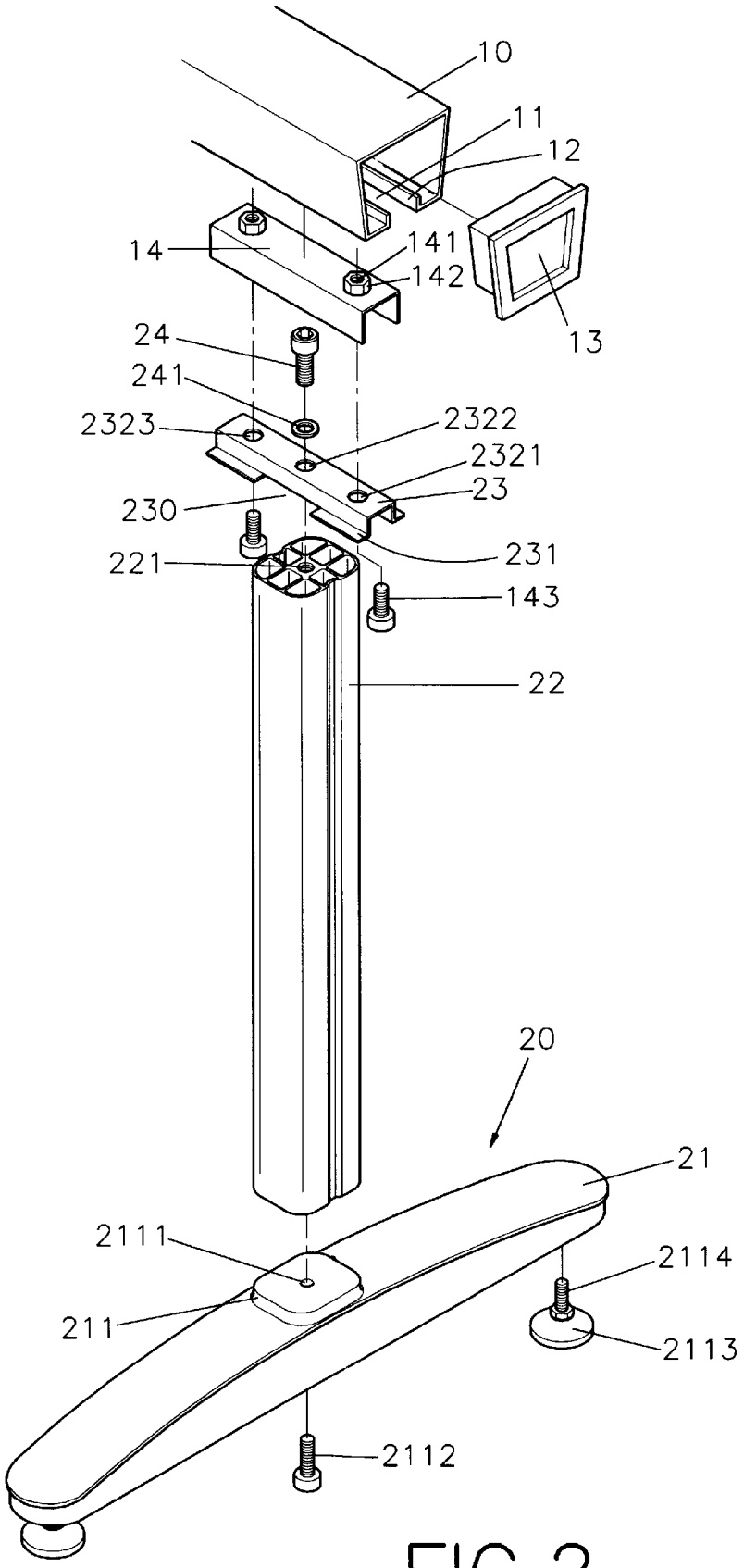
FIG. 2 is a perspective exploded view of a crossbar, an extended rod, and a leg plate.
Figure 3:
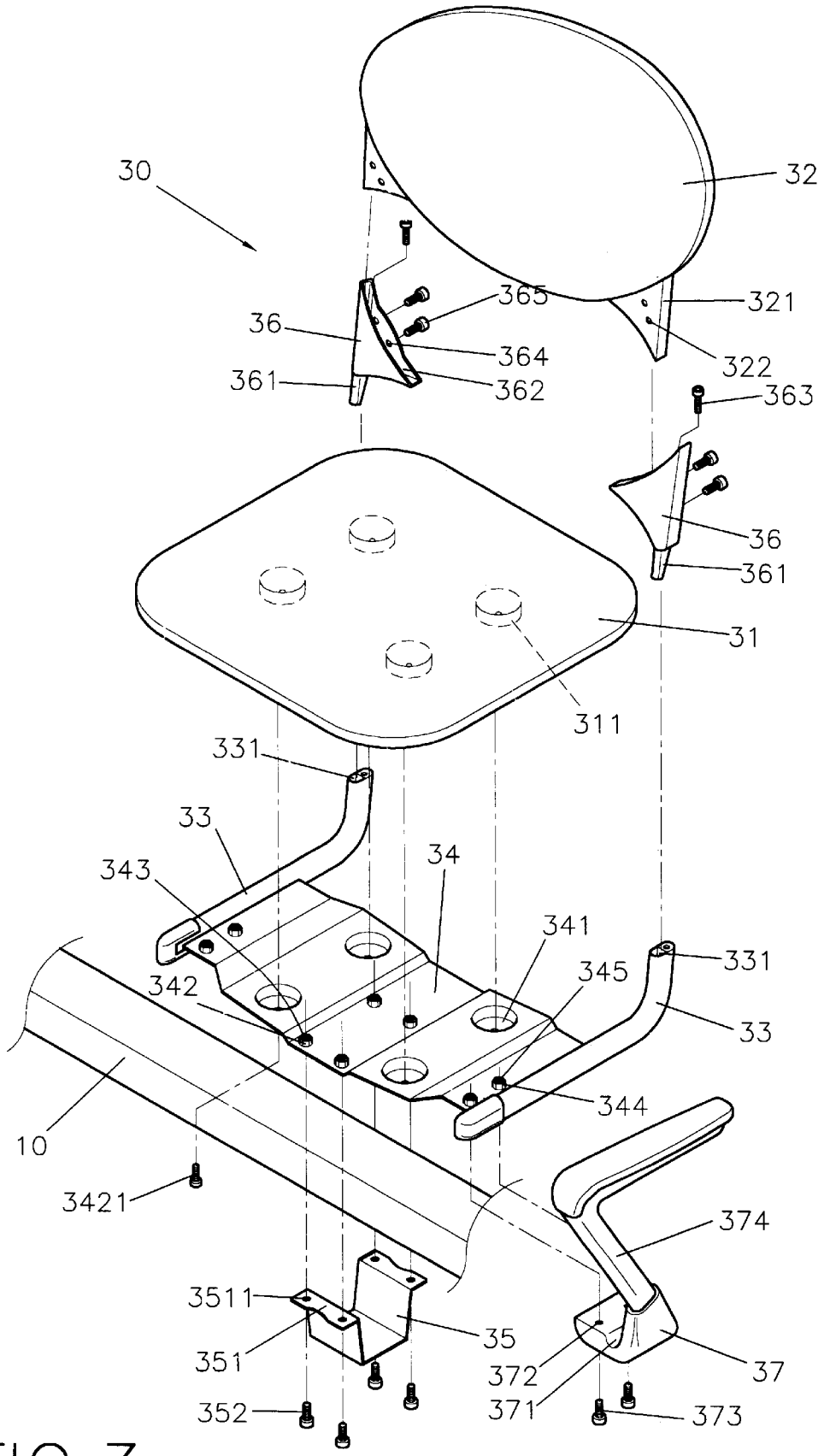
FIG. 3 is a perspective exploded view of a chair.
Figure 4:
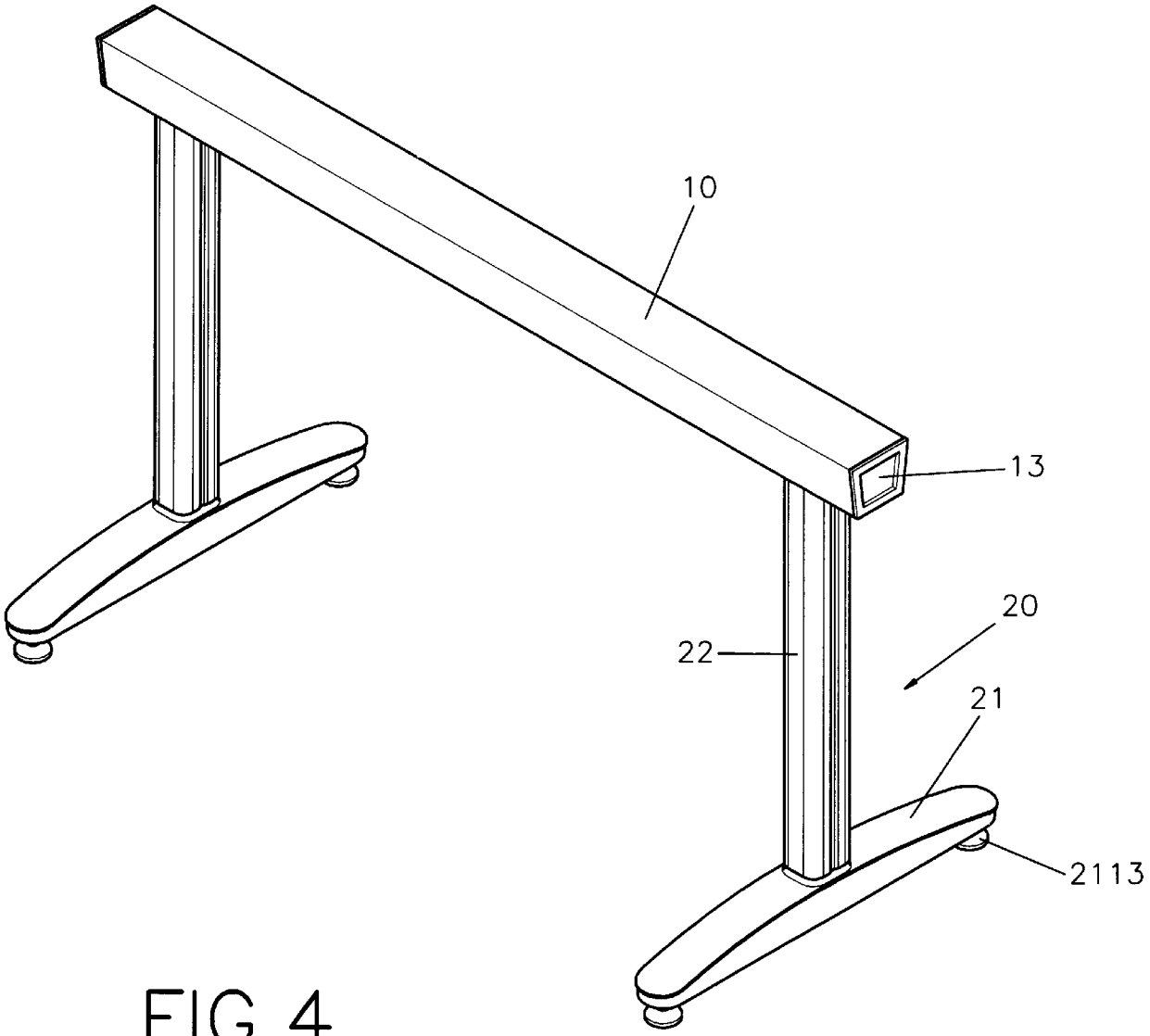
FIG. 4 is a perspective assembly view of a crossbar, two extended rods, and two leg plates.
Figure 5:
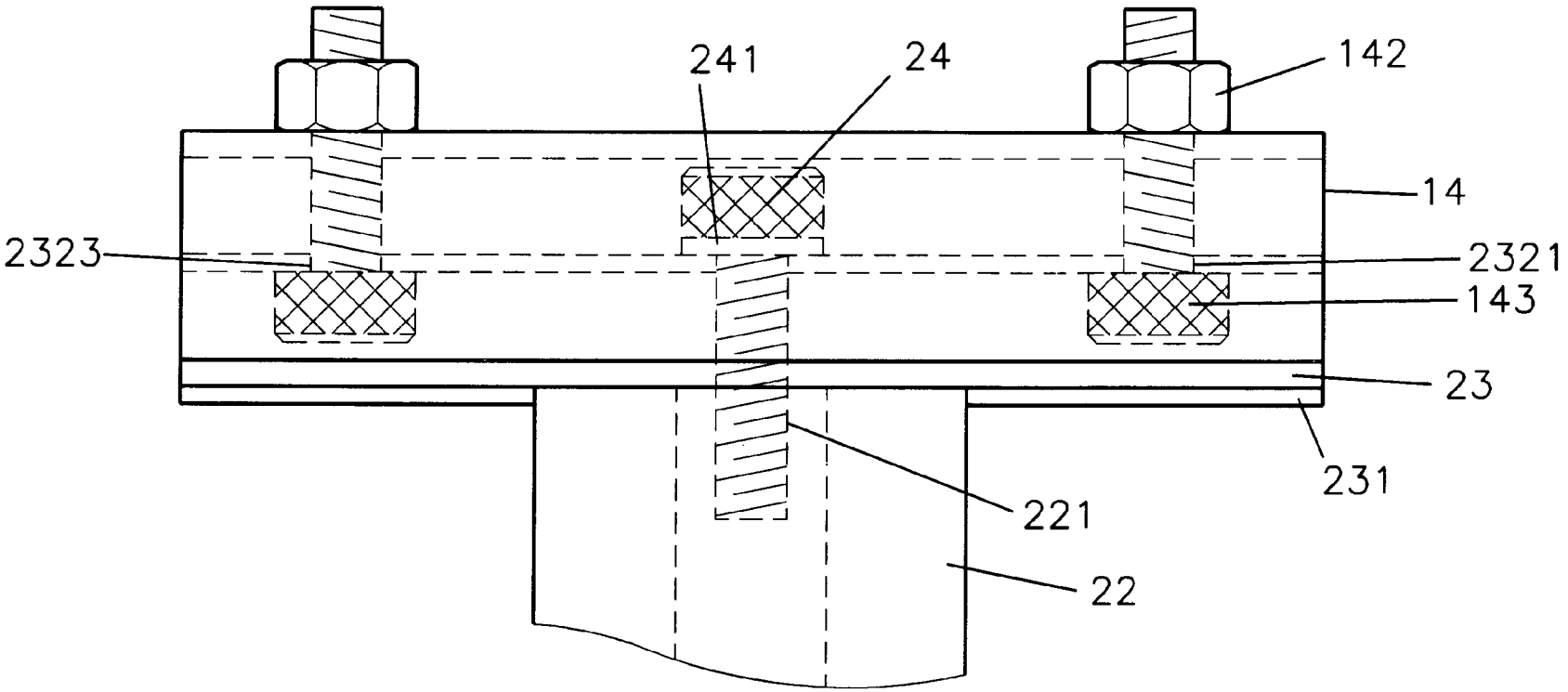
FIG. 5 is an elevational schematic view illustrating an assembly of a U-shaped plate, a connection plate, and an extended rod.
Figure 6:
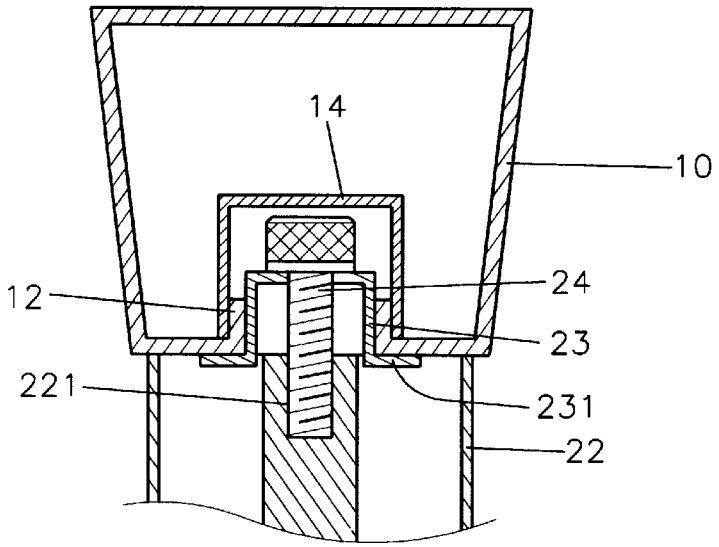
FIG. 6 is a sectional view of FIG. 5.
Figure 7:
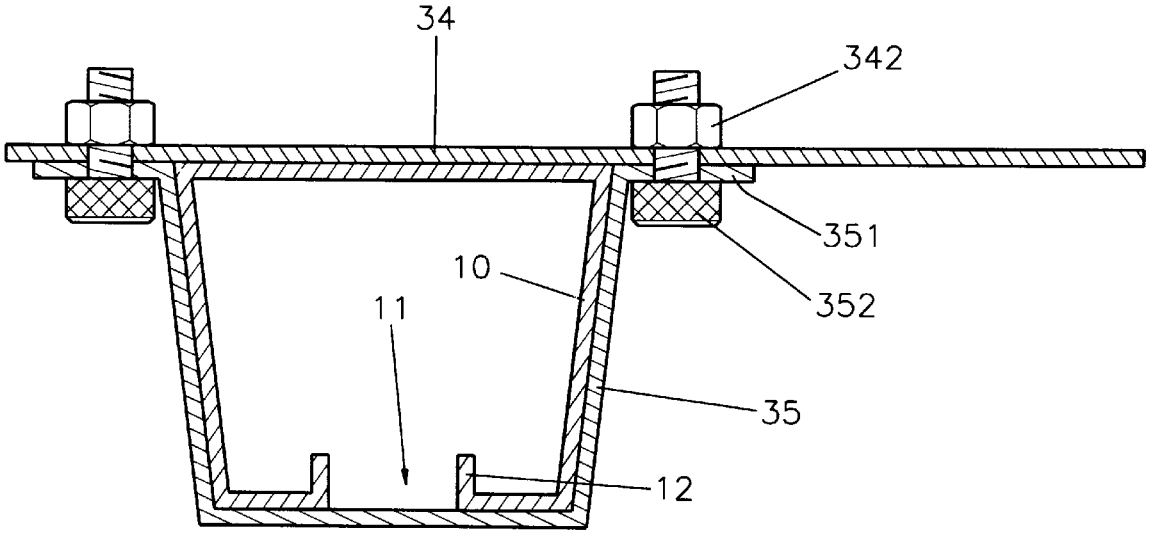
FIG. 7 is a sectional assembly view of a U-shaped positioning plate, a crossbar, and a base plate.
Figure 8:
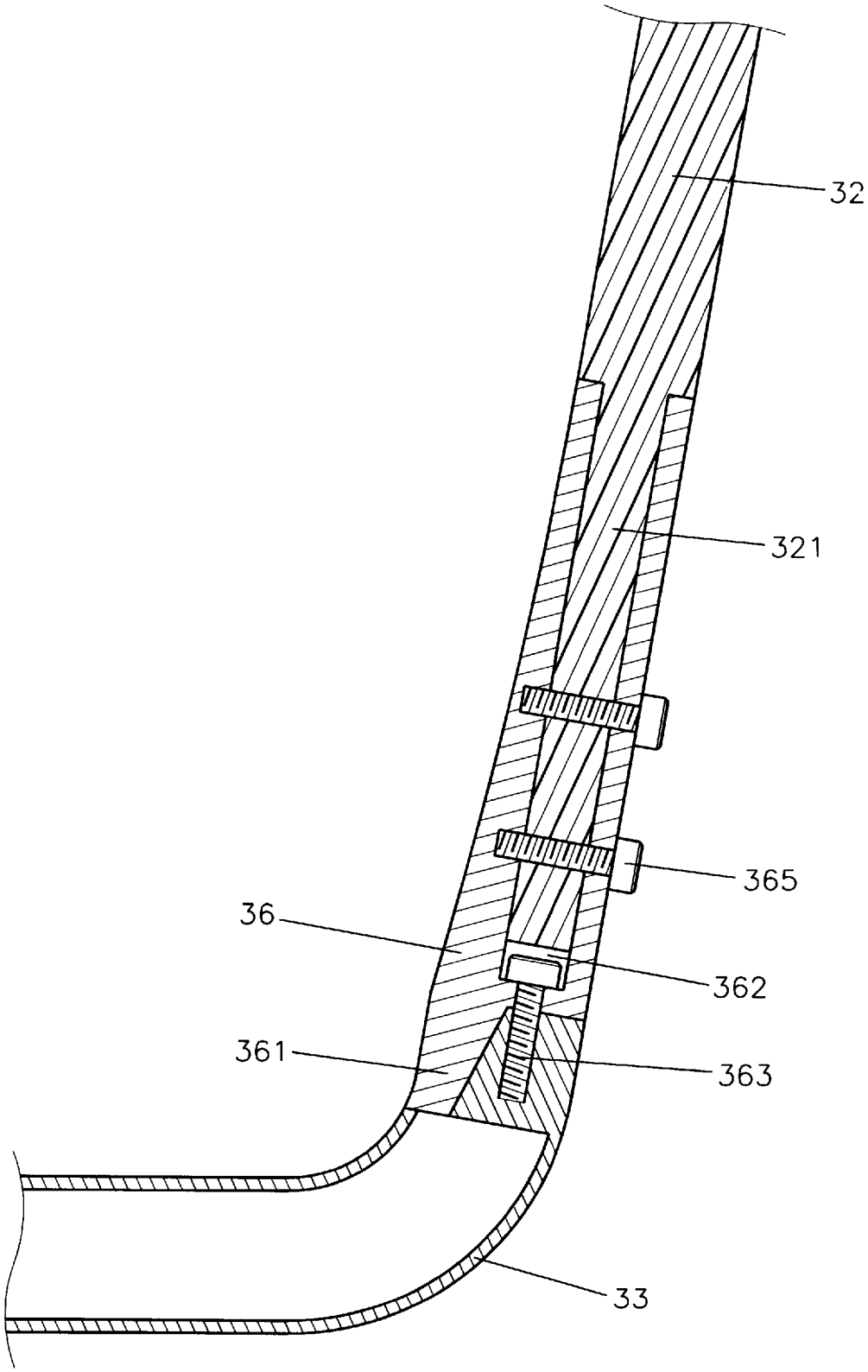
FIG. 8 is a sectional assembly view of an insertion block, a backrest plate, and an L-shaped support rod.
Figure 9:
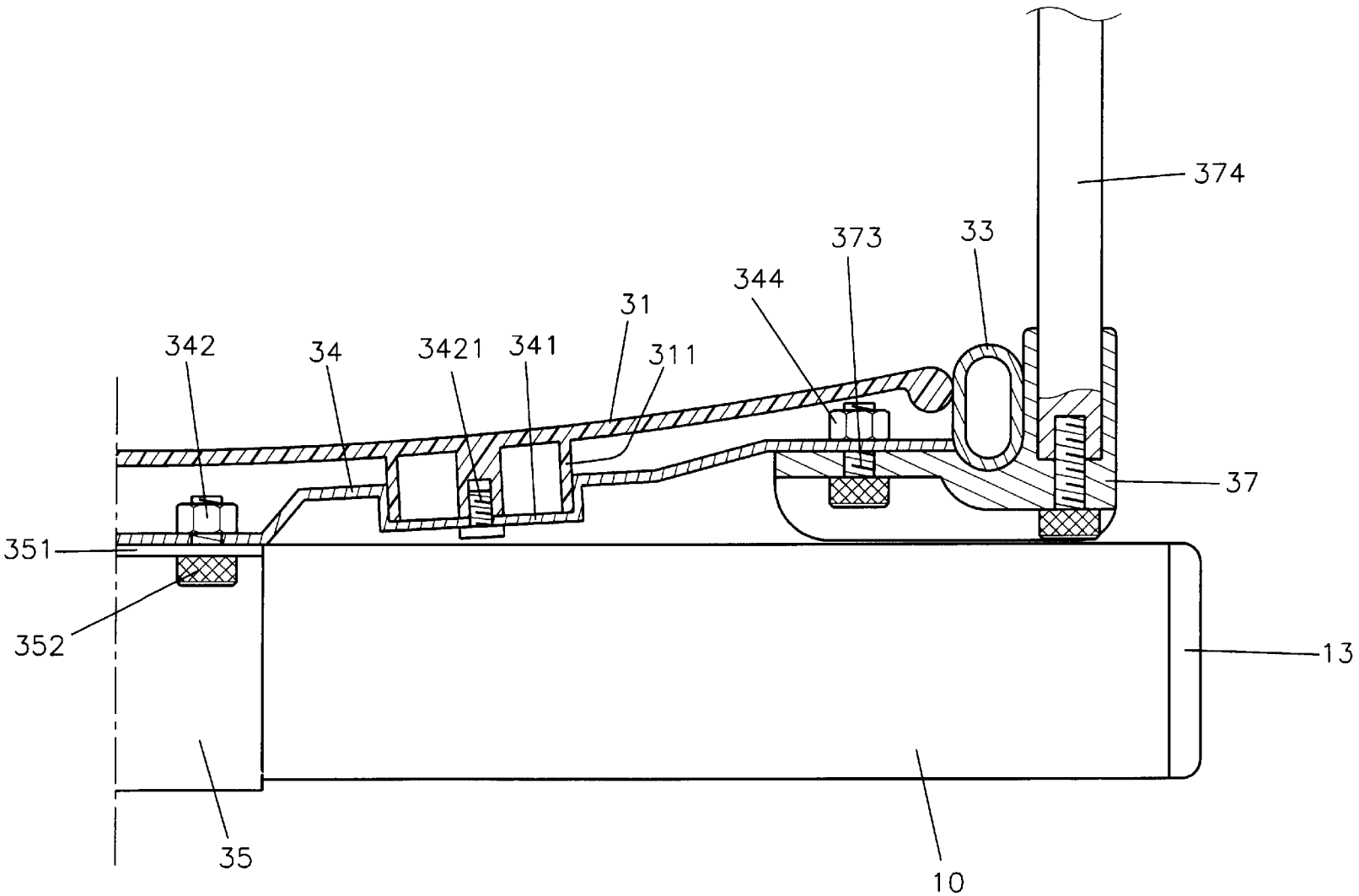
FIG. 9 is a sectional assembly view of a clamp block and a base plate.

Referring to FIGS. 1 to 9, a gang chair device comprises a hollow crossbar 10, two leg devices 20 connected to the hollow crossbar 10, and a plurality of chairs 30 disposed on the hollow crossbar 10. Each of the leg devices 20 has a leg plate 21 having a protruded plate 211 and an extended rod 22 disposed on the protruded plate 211. The protruded plate 211 has a threaded aperture 2111. A screw rod 2112 fastens the extended rod 22 and the protruded plate 211 via the threaded aperture 2111.

The extended rod 22 has a threaded center hole 221. A connection plate 23 is disposed on the extended rod 22. The connection plate 23 has a notch 230, a central hole 2322, a first round hole 2321, a second round hole 2323, and a plurality of lug bars 231.

The hollow crossbar 10 has two block plates 12 and a slot 11 defined by the block plates 12. A U-shaped plate 14 is inserted in the hollow crossbar 10. The U-shaped plate 14 has two positioning holes 141.

Each of the chairs 30 has a backrest plate 32 having two insertion plates 321, two hollow blocks 36, a seat plate 31, a base plate 34, two armrest frames 374, and a U-shaped positioning plate 35 receiving the hollow crossbar 10. The U-shaped positioning plate 35 has two end bars 351. Each of the end bars 351 has two threaded holes 3511. The seat plate 31 has a plurality of round protrusions 311. The base plate 34 is disposed on the hollow crossbar 10. The seat plate 31 is disposed on the base plate 34.

The base plate 34 has two J-shaped lateral rods 33, a plurality of circular apertures 345, and a plurality of round recesses 341 receiving the round protrusions 311. Each of the J-shaped lateral rods 33 has an opening 331.

Each of the insertion plates 321 is inserted in the respective hollow block 36. Each of the hollow blocks 36 has a hollow interior 362 receiving the respective insertion plate 321, two through holes 364, and a tip end 361 inserted in the respective opening 331.

Each of the armrest frames 374 has a lower base 37 positioned on the base plate 34.

The lower base 37 has a groove 371 and two through apertures 372. Each of the insertion plates 321 has two positioning apertures 322.

The leg plate 21 is disposed on two disk feet 2113. Each of the disk feet 2113 has a threaded rod 2114 inserted in the leg plate 21. A plug 13 plugs an end of the crossbar 10.

Referring to FIGS. 1 to 9 again, a bolt 24 passes through a washer 241, the central hole 2322, and the threaded center hole 221 to fasten the connection plate 23 and the extended rod 22 together. Two bolts 143 and two nuts 142 fasten the connection plate 23 and the U-shaped plate 14 together via the round hole 2321, 2323 and the positioning holes 141. Two screws 373 fasten the lower base 37 and the base plate 34 together via the through apertures 372 and the circular apertures 345 and nuts 344. A screw 3421 fastens the seat plate 31 and the base plate 34 together. Four screws 352 fastens the end bars 351 and the base plate 34 together. Two screws 365 fasten the insertion plate 321 and the respective hollow block 36 together. A screw 363 is inserted in the tip end 361 and the opening 331 to fasten the J-shaped lateral rods 33 and the respective hollow block 36 together.

I claim:

1. A gang chair device comprising:

a hollow crossbar having two ends, a pair of leg members perpendicularly connected to the two ends thereof respectively and a plurality chairs disposed in alignment on the hollow crossbar and facing the same direction;

said hollow crossbar having a pair of longitudinal block plates to define a longitudinal slot therebetween and in an underside of the crossbar;

a pair of plug members covering two ends of the hollow crossbar respectively;

said leg members each including a threaded central bore in a top and lower end;

a connection plate connecting to the top end of each of the leg members and each including a central hole, a pair of first and second through holes on two longitudinal sides of the central hole, a notch centrally formed in a lateral side thereof and a first bolt wrapped with a washer perpendicularly connecting the connection plate to the top of the leg member through central hole of the plate and the central bore of the leg member;

a U-shaped plate sliding into an end portion of the hollow crossbar and including a pair of positioning holes corresponding to and engageable with the first and second through holes of the connection plate so as to connect with the connection plate by a pair of bolts;

an elongate leg plate perpendicularly connected to the lower ends of each leg member by a bolt through a threaded aperture in a rectangular protrusion on a central top of the leg plate and the central bore in the lower end of the leg member, said rectangular protrusion being engageable with a lower end of the leg member and a pair of disk foot means spacedly screwed to an underside of the leg plate adjacent two ends thereof.

2. The gang chair as recited in claim 1 wherein:

a base plate including a flat portion, a pair of J-shaped lateral rods integrated on lateral sides of the base plate, each J-shaped rod having an opening in top, the base plate having a plurality of screw holes, and a plurality of round recesses spacedly and alternately formed in the flat portion of the base plate;

a U-shaped fastener including a pair of lateral flanges, each having a pair of screw holes formed spaced apart and corresponding to and engageable with the screw holes of the base plate so as to fasten the base plate to the hollow crossbar by bolts;

a seat member including a plurality of round protrusions spacedly formed on an underside of the seat member and corresponding to and engageable with the round recesses of the base plate so as to frictionally dispose the seat member to the base plate;

a backrest member including a pair of triangular insertion plates spacedly extending downwardly, each having a pair of screw holes formed spaced apart;

a pair of triangular hollow blocks engageable with the triangular insertion plates, each block having a pair of spaced screw holes corresponding to and engageable with the screw holes of the triangular insertion plates so as to fasten the triangular hollow blocks to the triangular insertion plates respectively by screws, and a tip end projected downwardly and inserted into the opening of the J-shaped lateral rods respectively.

3. The gang chair as recited in claim 2 further includes a pair of armrests each having a frame and a lower base which has a pair of spaced screw holes corresponding to and engageable with the screw holes adjacent the J-shaped lateral rods of the base plate from underneath the base plate, enabling fastening of the armrests to the base plate respectively.

* * * * *